US009126716B2

(12) United States Patent
Kohler et al.

(10) Patent No.: US 9,126,716 B2
(45) Date of Patent: Sep. 8, 2015

(54) CARTON WITH HANDLE

(71) Applicant: Graphic Packaging International, Inc., Atlanta, GA (US)

(72) Inventors: Karl A. Kohler, Bartlett, IL (US); Raymond S. Kastanek, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/891,339

(22) Filed: May 10, 2013

(65) Prior Publication Data

US 2013/0302130 A1 Nov. 14, 2013

Related U.S. Application Data

(60) Provisional application No. 61/688,341, filed on May 11, 2012.

(51) Int. Cl.
*B65D 5/46* (2006.01)
*B65D 71/36* (2006.01)

(52) U.S. Cl.
CPC ..... *B65D 5/46072* (2013.01); *B65D 71/36* (2013.01); *B65D 2571/0045* (2013.01); *B65D 2571/0066* (2013.01); *B65D 2571/00141* (2013.01); *B65D 2571/00549* (2013.01); *B65D 2571/00574* (2013.01); *B65D 2571/00728* (2013.01)

(58) Field of Classification Search
CPC ..... B65D 5/46072; B65D 5/46; B65D 71/36; B65D 2571/00728; B65D 2571/0045
USPC ..... 206/427; 229/117.13, 117.14, 117.15; 414/800; 493/162
See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |
| 2,702,144 | A | 2/1955 | Forrer |
| 2,797,856 | A | 7/1957 | Jaeschke |

(Continued)

FOREIGN PATENT DOCUMENTS

| | | |
|---|---|---|
| CA | 877792 | 8/1971 |
| CA | 2160145 | 9/1995 |

(Continued)

OTHER PUBLICATIONS

International Search Report and Written Opinion, mailed Aug. 13, 2013, for related application, No. PCT/2013/040499.

*Primary Examiner* — Steven A. Reynolds
(74) *Attorney, Agent, or Firm* — Womble Carlyle Sandridge & Rice, LLP

(57) ABSTRACT

A carton for containing a plurality of articles. The carton includes a plurality of panels that extends at least partially around an interior of the carton. A handle extends in at least one panel of the plurality of panels. The handle can include a handle grip and at least one handle opening. The at least one handle opening can include a main portion extending adjacent the handle grip of the handle and an expanded portion that is for being generally aligned with a respective space at least partially defined by at least two adjacent articles of the plurality of articles. The expanded portion can allow access to the respective space via the at least one handle opening.

34 Claims, 9 Drawing Sheets

(56) References Cited

U.S. PATENT DOCUMENTS 2,810,506 A 10/1957 Kessler
2,868,433 A 1/1959 Anderson, Jr.
2,955,739 A 10/1960 Collura
3,112,856 A 12/1963 MacIntosh et al.
3,127,720 A 4/1964 Gentry et al.
3,204,814 A 9/1965 Mahon
3,204,815 A 9/1965 Weiss
3,309,005 A 3/1967 Pilger
3,334,767 A 8/1967 Cornelius
3,355,012 A 11/1967 Weiss
3,381,881 A 5/1968 Granz et al.
3,828,926 A 8/1974 Rossi
3,386,901 A 6/1975 Zeitler
3,894,681 A 7/1975 Arneson et al.
3,904,036 A 9/1975 Forrer
3,933,303 A 1/1976 Kirby, Jr.
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,418,864 A 12/1983 Nielsen
4,424,901 A 1/1984 Lanier
4,440,340 A 4/1984 Bakx
4,478,334 A 10/1984 Graser
4,482,090 A * 11/1984 Milliens ..... 206/427
4,498,619 A 2/1985 Roccaforte
4,508,258 A 4/1985 Graser
4,538,759 A 9/1985 Dutcher
4,545,485 A 10/1985 Oliff
4,546,914 A 10/1985 Rocca
4,577,799 A 3/1986 Oliff
4,588,084 A 5/1986 Holley, Jr.
4,653,686 A 3/1987 Wood et al.
4,706,876 A 11/1987 Wilson
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,966,324 A 10/1990 Steel
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 De Maio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A * 3/1994 Sutherland ..... 229/117.13
5,303,863 A 4/1994 Arasim
5,307,932 A * 5/1994 Stout et al. ..... 206/141
5,307,986 A 5/1994 Schuster
5,320,277 A 6/1994 Stout et al.
5,328,081 A 7/1994 Saulas
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,472,090 A 12/1995 Sutherland
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,593,027 A 1/1997 Sutherland
5,639,017 A * 6/1997 Fogle ..... 229/117.14
5,647,483 A 7/1997 Harris
5,669,500 A 9/1997 Sutherland
5,699,957 A 12/1997 Blin et al.
5,704,470 A 1/1998 Sutherland
5,738,273 A 4/1998 Auclair
5,794,778 A 8/1998 Harris
5,826,782 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 10/2001 Stout
D452,154 S 12/2001 Rhodes et al.
6,425,520 B1 7/2002 Peterson
6,523,739 B2 2/2003 Heeley et al.
6,536,656 B2 3/2003 Auclair et al.
6,631,803 B2 10/2003 Rhodes et al.
6,669,083 B2 12/2003 Bates
6,758,337 B2 7/2004 Chargueraud et al.
6,766,940 B2 7/2004 Negelen
6,834,793 B2 12/2004 Sutherland
6,848,573 B2 2/2005 Gould et al.
6,869,009 B2 3/2005 Sutherland et al.
6,899,221 B2 * 5/2005 Skolik et al. ..... 206/141
6,905,066 B2 6/2005 Holley et al.
6,926,193 B2 8/2005 Smalley
6,945,450 B2 9/2005 Rusnock
6,968,992 B2 11/2005 Schuster
7,234,596 B2 6/2007 Lebras
7,296,731 B2 11/2007 Auclair et al.
7,380,701 B2 6/2008 Fogle et al.
7,416,109 B2 8/2008 Sutherland
7,427,010 B2 9/2008 Sutherland
7,467,713 B2 12/2008 Harrelson
7,472,791 B2 1/2009 Spivey, Sr.
7,601,111 B2 10/2009 Sutherland et al.
7,699,215 B2 4/2010 Spivey, Sr.
7,712,653 B2 5/2010 DeBusk et al.
7,743,944 B2 6/2010 Ho Fung et al.
7,743,968 B2 6/2010 Theelen
7,748,603 B2 7/2010 Fogle et al.
7,757,933 B2 7/2010 Dunn
7,793,779 B2 9/2010 Spivey, Sr. et al.
7,806,314 B2 10/2010 Sutherland
8,191,761 B2 6/2012 Brand
8,216,118 B2 7/2012 Dunn
8,348,142 B2 1/2013 Smalley
2003/0213263 A1 11/2003 Woog
2004/0050917 A1 3/2004 Smalley
2004/0074954 A1 4/2004 Fogle et al.
2005/0056658 A1 3/2005 Spivey
2005/0087592 A1 4/2005 Schuster
2005/0167478 A1 8/2005 Holley, Jr.

(56) References Cited

U.S. PATENT DOCUMENTS

| | | | | |
|---|---|---|---|---|
| 2006/0071058 | A1 | 4/2006 | Spivey | |
| 2006/0169755 | A1 | 8/2006 | Spivey, Sr. | |
| 2006/0273143 | A1 | 12/2006 | Finch | |
| 2007/0039846 | A1 | 2/2007 | Spivey | |
| 2007/0051781 | A1 | 3/2007 | Holley, Jr. | |
| 2007/0108261 | A1 | 5/2007 | Schuster | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0083820 | A1 | 4/2008 | Walling et al. | |
| 2008/0099544 | A1 | 5/2008 | Skolik | |
| 2008/0119344 | A1 | 5/2008 | Sutherland et al. | |
| 2009/0236408 | A1 | 9/2009 | Spivey, Sr. et al. | |
| 2009/0255983 | A1 | 10/2009 | DePaula et al. | |
| 2010/0213249 | A1 | 8/2010 | Requena et al. | |
| 2011/0068160 | A1* | 3/2011 | Brand et al. | 229/199 |
| 2011/0290692 | A1 | 12/2011 | Spivey, Sr. | |
| 2011/0290867 | A1* | 12/2011 | Schemmel et al. | 229/117.13 |
| 2012/0012600 | A1 | 1/2012 | Gonzalez | |
| 2012/0211552 | A1 | 8/2012 | Kastanek et al. | |
| 2012/0321754 | A1 | 12/2012 | Block | |
| 2013/0146649 | A1* | 6/2013 | Spivey et al. | 229/117.13 |
| 2013/0186045 | A1* | 7/2013 | Kastanek et al. | 53/492 |

FOREIGN PATENT DOCUMENTS

| | | |
|---|---|---|
| DE | 8514718 | 6/1985 |
| DE | 29607374 | 8/1996 |
| DE | 20112228 | 11/2002 |
| DE | 202004018649 | 5/2005 |
| EP | 0412226 | 2/1991 |
| EP | 0473266 | 3/1992 |
| EP | 1612157 | 1/2008 |
| FR | 1494239 | 7/1966 |
| FR | 2579175 | 9/1986 |
| JP | 8503187 | 4/1996 |
| JP | 2005507831 | 5/2003 |
| KR | 20-0356729 | 4/2004 |
| WO | WO94/10047 | 5/1994 |
| WO | WO96/27538 | 9/1996 |
| WO | WO99/28207 | 6/1999 |
| WO | WO00/78618 | 6/2000 |
| WO | WO01/66434 | 2/2001 |
| WO | WO03/037742 | 5/2003 |
| WO | WO2005/123532 | 6/2005 |
| WO | WO2005080218 | 9/2005 |
| WO | WO2007089282 | 8/2007 |

* cited by examiner

CARTON WITH HANDLE

CROSS-REFERENCE TO RELATED APPLICATIONS

This application claims the benefit of U.S. Provisional Patent Application No. 61/688,341, filed May 11, 2012.

INCORPORATION BY REFERENCE

The disclosure of U.S. Provisional Patent Application No. 61/688,341, which was filed on May 11, 2012, is hereby incorporated by reference for all purposes as if presented herein in its entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the present disclosure is generally directed to a carton for containing a plurality of articles. The carton comprises a plurality of panels that extends at least partially around an interior of the carton. A handle extends in at least one panel of the plurality of panels. The handle can comprise a handle grip and at least one handle opening. The at least one handle opening can comprise a main portion extending adjacent the handle grip of the handle and an expanded portion that is for being generally aligned with a respective space at least partially defined by at least two adjacent articles of the plurality of articles. The expanded portion can allow access to the respective space via the at least one handle opening.

In another aspect, the disclosure is generally directed to a blank for forming a carton for containing a plurality of articles. The blank comprises a plurality of panels and handle features extending in at least one panel of the plurality of panels for forming a handle when the carton is formed from the blank. The handle features can comprise at least one grip portion for forming a handle grip in the carton formed from the blank and at least one handle opening. The at least one handle opening can comprise a main portion extending adjacent the at least one grip portion and an expanded portion that is for being generally aligned with a respective space at least partially defined by at least two adjacent articles of the plurality of articles when the carton is formed from the blank. The expanded portion can allow access to the respective space via the at least one handle opening in the carton formed from the blank.

In another aspect, the disclosure is generally directed to a method for forming a carton for containing a plurality of articles. The method comprises obtaining a blank comprising a plurality of panels and handle features extending in at least one panel of the plurality of panels. The handle features can comprise at least one grip portion and at least one handle opening, and the at least one handle opening can comprise a main portion extending adjacent the at least one grip portion and an expanded portion. The method can further comprise forming an interior of the carton at least partially defined by the plurality of panels. The forming the interior of the carton can comprise forming an open-ended sleeve. The method can also comprise forming a handle from the handle features at least by forming a handle grip adjacent the at least one handle opening from the at least one grip portion and aligning the expanded portion with a respective space at least partially defined by at least two adjacent articles of the plurality of articles. The expanded portion can allow access to the respective space via the at least one handle opening.

In another aspect, the disclosure is generally directed to a method for using a carton containing a plurality of articles. The method comprises obtaining a carton comprising a plurality of panels that extends at least partially around an interior of the carton and a handle extending in at least one panel of the plurality of panels. The handle can comprise a handle grip and at least one handle opening, and the at least one handle opening can comprise a main portion extending adjacent the handle grip of the handle and an expanded portion that is generally aligned with a respective space at least partially defined by at least two adjacent articles of the plurality of articles. The method further can comprise gripping the carton at the handle by inserting at least a portion of a hand into the expanded portion of the at least one handle opening and into the respective space, and moving the carton by applying at least a portion of a moving force against at least one of the articles of the plurality of articles.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans) as disposed within the carton embodiments. In this specification, the terms "inner," "interior," "outer," "exterior," "lower," "bottom," "upper," and "top" indicate orientations determined in relation to fully erected and upright cartons.

Figure 1:
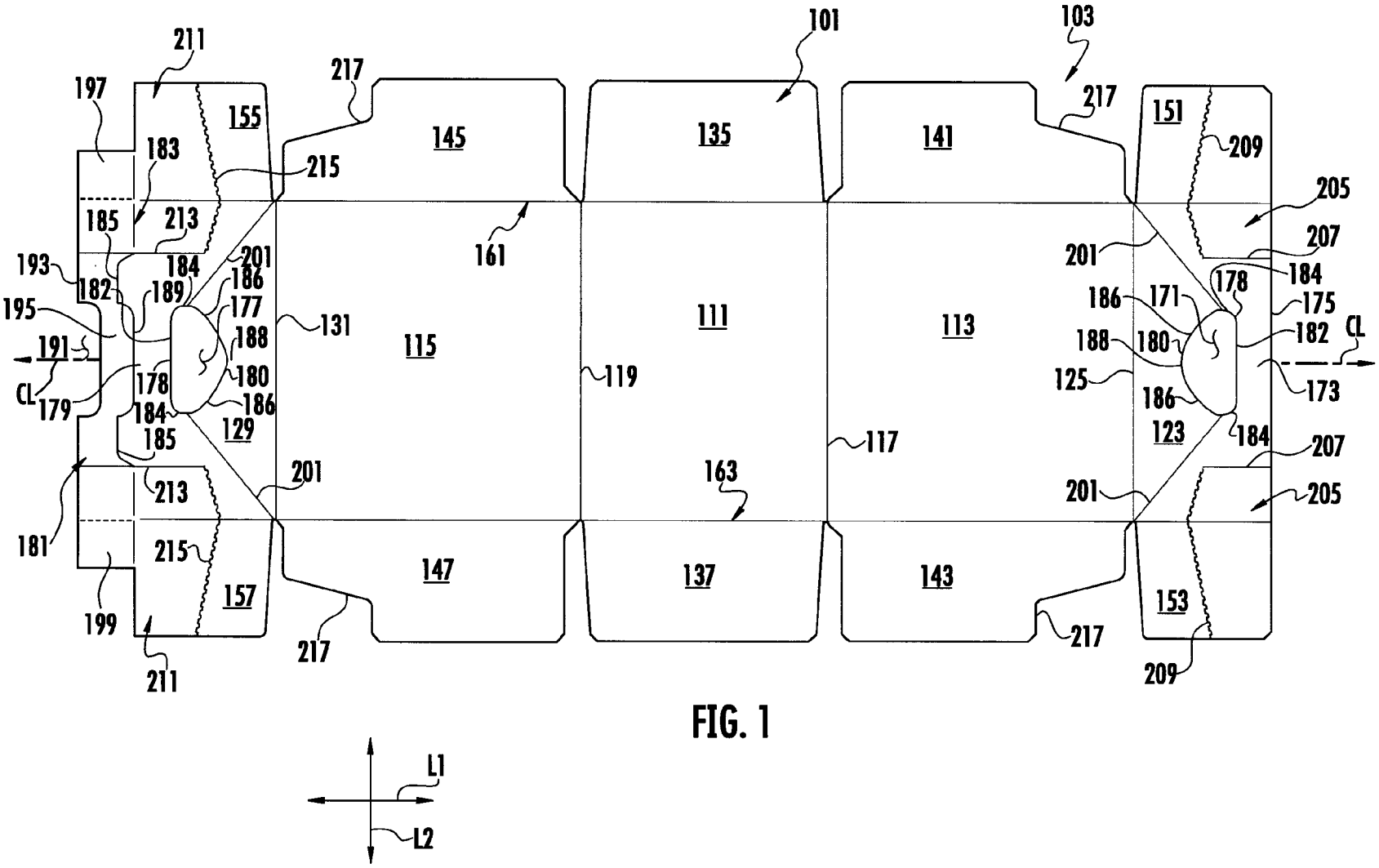
FIG. 1 is an exterior plan view of a blank for forming a carton according to a first exemplary embodiment of the disclosure.

FIG. 1 is a plan view of the exterior side 101 of a blank, generally indicated at 103, used to form a carton 105 (FIGS. 6 and 7) according to one exemplary embodiment of the disclosure. The carton 105 can be used to house a plurality of articles such as containers C (FIG. 7). The carton 105 has a handle, generally indicated at 107 (FIGS. 3-7), for grasping and carrying the carton. In one illustrated embodiment, the carton 105 is sized to house twenty-four containers in two layers in a 3×4 arrangement, but it is understood that the carton may be sized and shaped to hold containers of a different or same quantity in a single layer, more than two layers, and/or in different row/column arrangements (e.g., 1×6, 3×6, 2×6, 4×6, 2×6×2, 2×9, 3×5, 3×5×2, etc.). In the illustrated embodiment, the containers C are cans, but other types of containers (e.g., bottles) can be used in the carton 105.

The blank 103 has a longitudinal axis L1 and a lateral axis L2. The blank 103 comprises a bottom panel 111 foldably connected to first and second side panels 113, 115 at respective lateral fold lines 117, 119, a first top panel 123 foldably connected to the first side panel 113 at a lateral fold line 125, and a second top panel 129 foldably connected to the second side panel 115 at a lateral fold line 131. In the illustrated embodiment, the first and second top panels 123, 129 can at least partially overlap in the erected carton 105.

The bottom panel 111 is foldably connected to a first bottom end flap 135 and a second bottom end flap 137. The first side panel 113 is foldably connected to a first side end flap 141 and a second side end flap 143. The second side panel 115 is foldably connected to a first side end flap 145 and a second side end flap 147. The first top panel 123 is foldably connected to a first top end flap 151 and a second top end flap 153. The second top panel 129 is foldably connected to a third top end flap 155 and a fourth top end flap 157.

Figure 5:
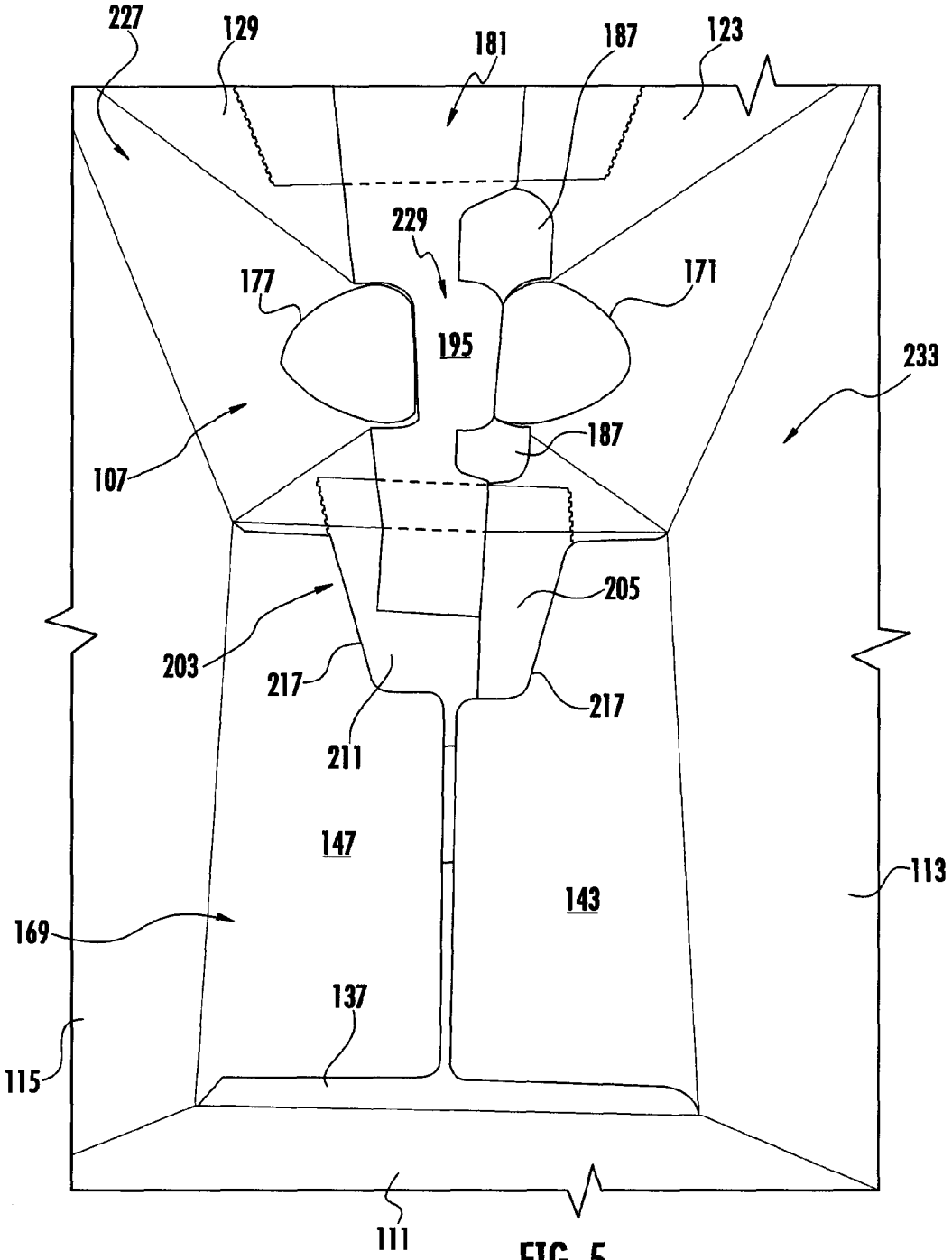
FIG. 5 is an interior perspective view of a top wall and a closed end of the carton according to the first embodiment of the disclosure.

The end flaps 135, 141, 145, 151, 155 extend along a first marginal area of the blank 103, and are foldably connected at a first longitudinal fold line 161 that extends along the length of the blank. The end flaps 137, 143, 147, 153, 157 extend along a second marginal area of the blank 103, and are foldably connected at a second longitudinal fold line 163 that also extends along the length of the blank. The longitudinal fold lines 161, 163 may be, for example, substantially straight, offset, or oblique at one or more locations to account for blank thickness or for other factors. When the carton 105 is erected, the end flaps 135, 141, 145, 151, 155 close a first end 167 of the carton (FIG. 6), and the end flaps 137, 143, 147, 153, 157 close a second end 169 of the carton (FIG. 5). In accordance with an alternative embodiment of the present invention, different flap arrangements can be used for closing the ends 167, 169 of the carton 105.

Figure 1A:
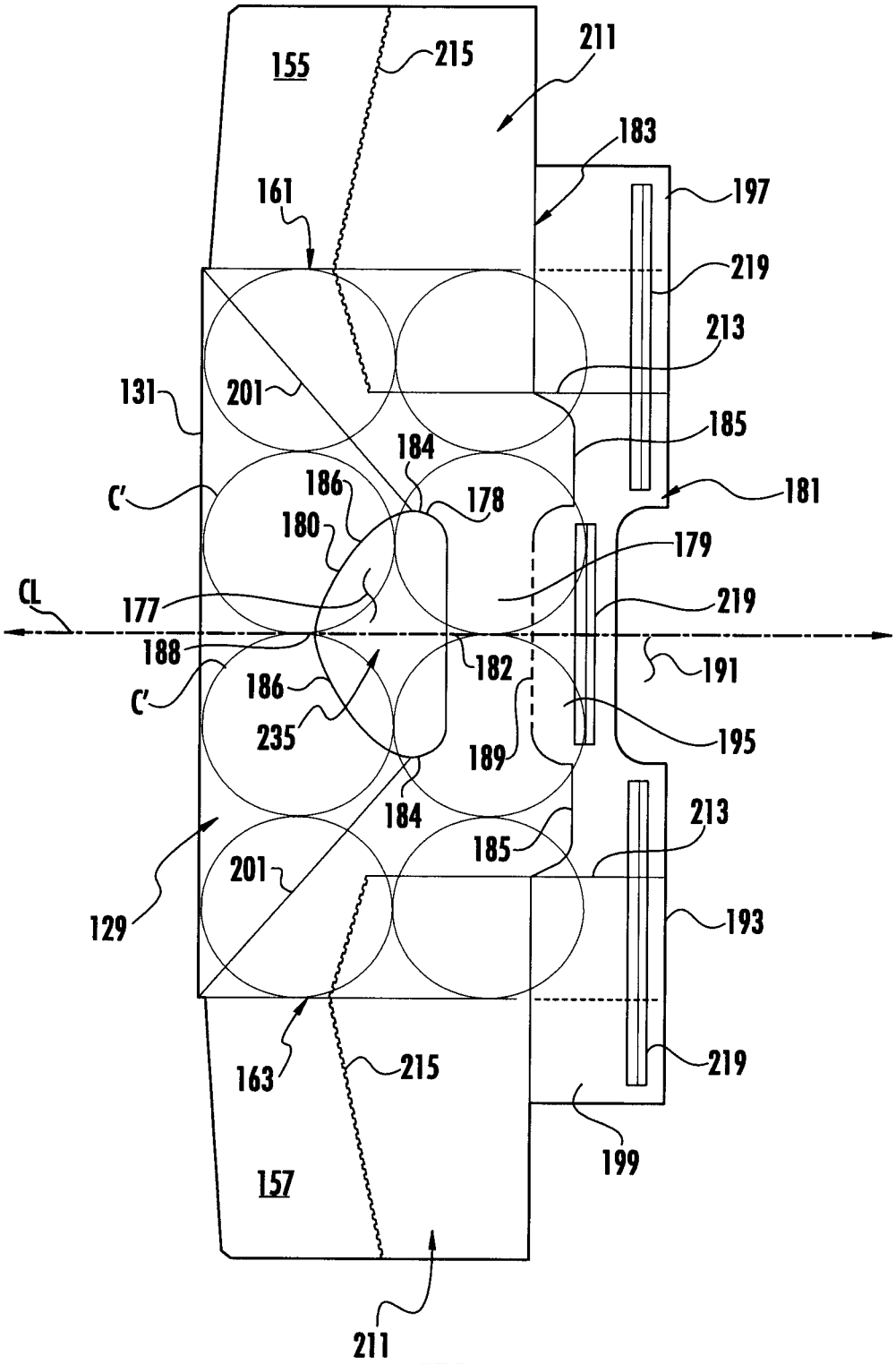
FIG. 1A is a detail plan view of a top panel and a handle reinforcement flap of the blank of FIG. 1.

As shown in FIG. 1, the features that comprise the handle 107 include a first handle opening 171 and a first grip portion 173 adjacent to the first handle opening 171 in the first top panel 123. In one embodiment, the first grip portion 173 extends from the first handle opening 171 to a laterally-extending edge 175 of the blank 103. As shown in FIGS. 1 and 1A, the features that comprise the handle 107 also comprise a second handle opening 177 and a second grip portion 179 adjacent to the second handle opening 177 in the second top panel 129. In the illustrated embodiment, the handle openings 171, 177 have an extended shape in order to help reduce tearing of the carton under certain uses of the handle 107. In one embodiment, the extended shape of the handle openings can include a main portion 178 extending adjacent the respective grip portions 173, 179 and an expanded portion 180 extending toward the respective lateral fold lines 125, 131 from the respective main portions 178. In the illustrated embodiment, each of the handle openings 171, 177 can include a grip edge 182 and two curved edges 184 that at least partially define the main portion 178 of the handle opening and two generally concave edges 186 that at least partially define the expanded portion 180 of the handle opening. As shown in FIGS. 1 and 1A, the concave edges 186 can extend from the respective curved edges 184 to an intersection point 188 that is spaced apart from the grip edge 182 along the longitudinal centerline CL. For example, the extended shapes of the handle openings 171, 177 and the placement of the containers C (e.g., as represented by the circles C' in FIG. 1A) can encourage a user to pull against the containers C instead of the top panels 123, 129 when utilizing only a single handle opening 171, 177 instead of the entire handle 107 (e.g., when pulling the carton 105 closer to the user while sliding the carton on a shelf). Accordingly, the extended shapes of the handle openings 171, 177 can help avoid undesired tearing of the carton 105. The handle openings 171, 177, the grip portions 173, 179, and/or the edge 175 could be otherwise shaped, arranged, and/or configured without departing from the disclosure.

Figure 2:
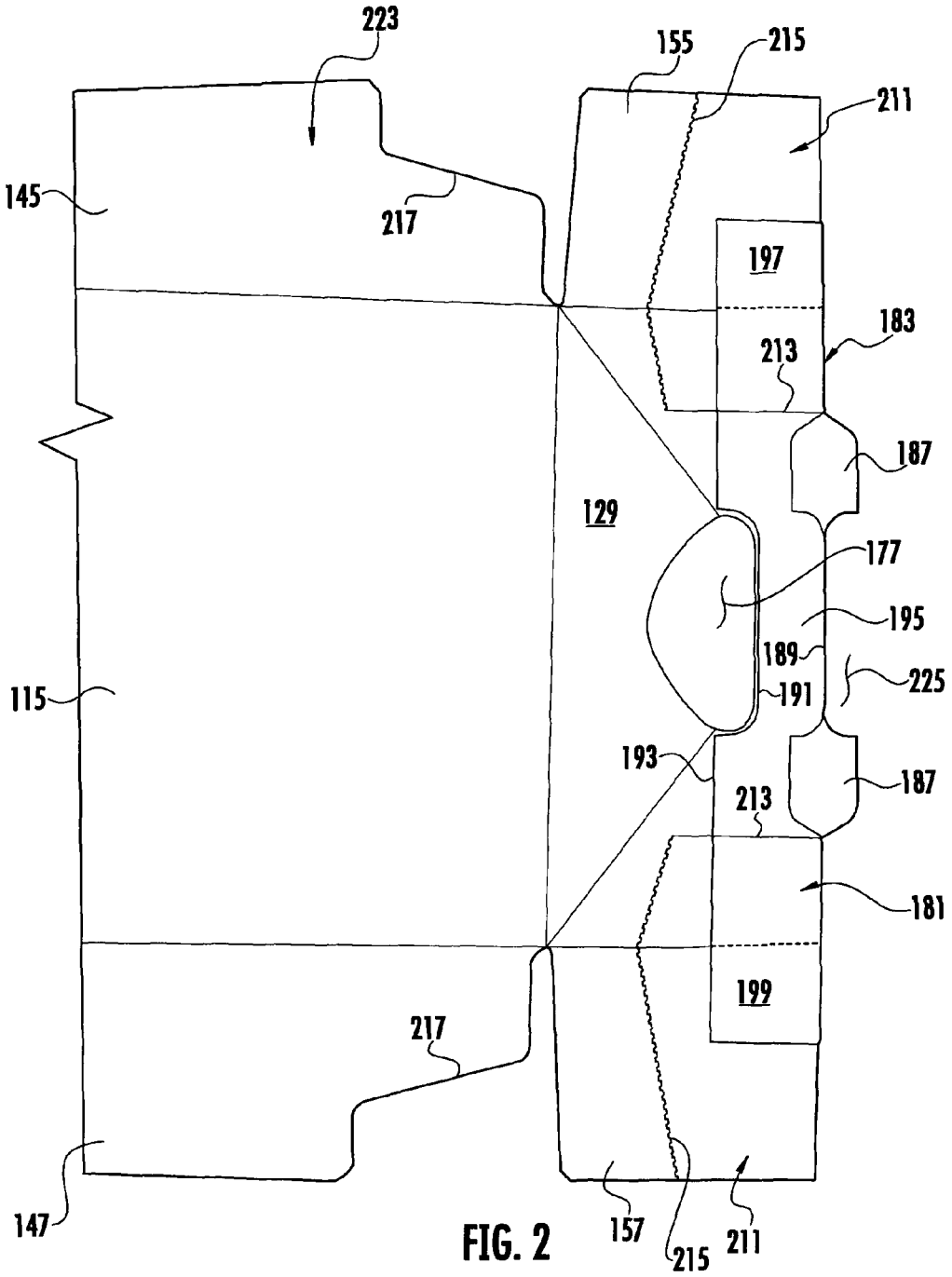
FIG. 2 is a perspective view showing the blank of FIG. 1 with the handle reinforcement flap folded relative to the top panel according to the first embodiment of the disclosure.
Figure 3:
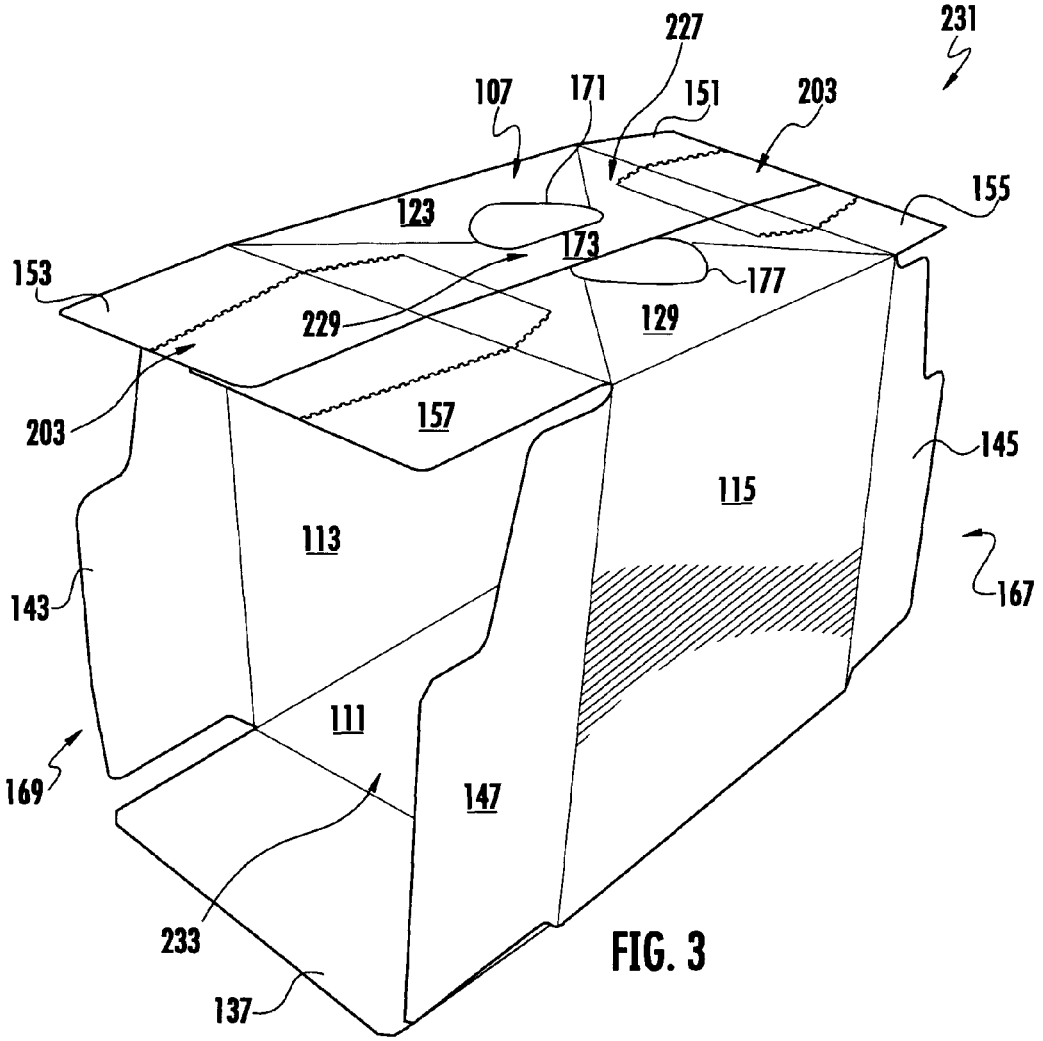
FIG. 3 is a perspective view of an open-ended sleeve formed from the blank of FIG. 1 according to the first embodiment of the disclosure.
Figure 4:
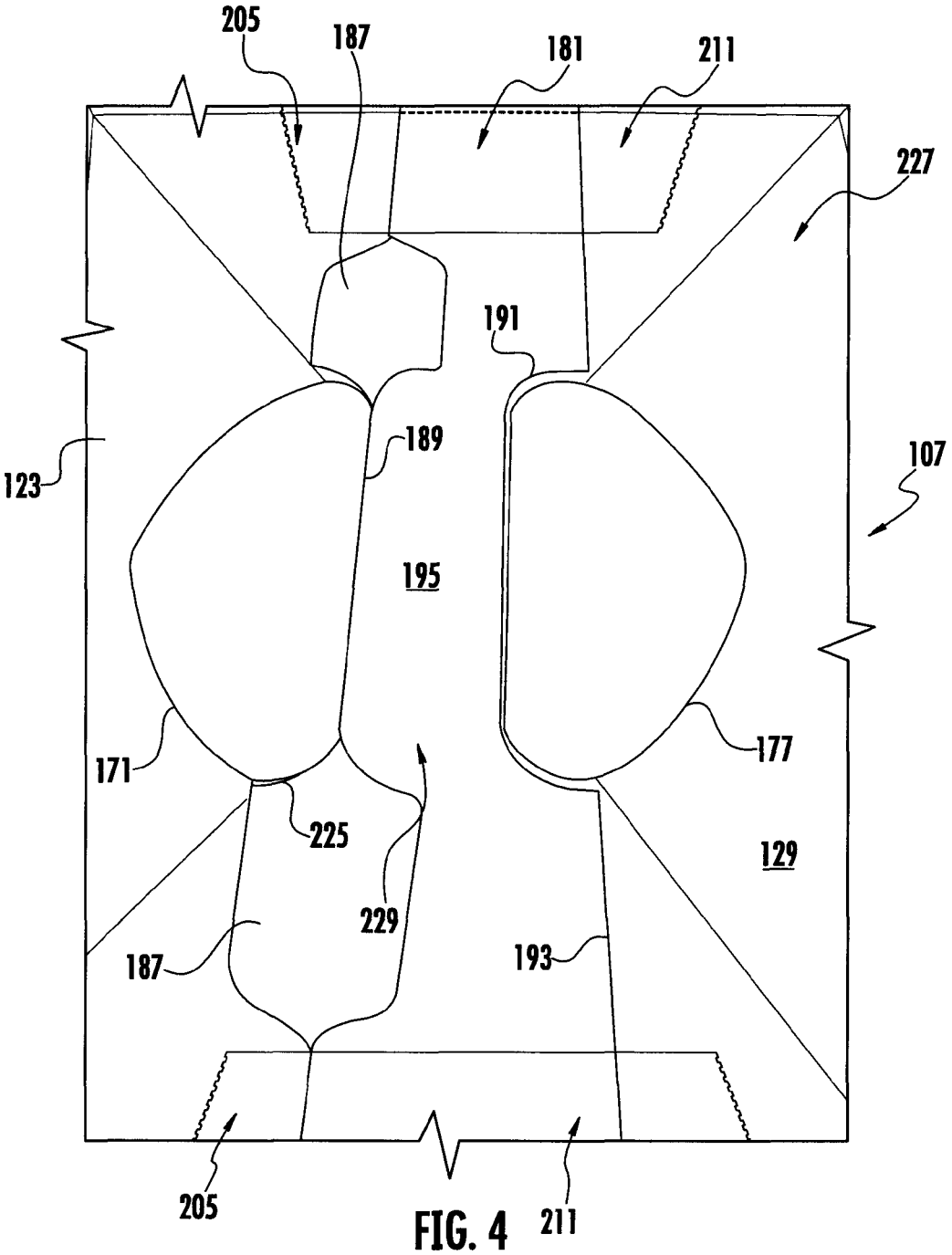
FIG. 4 is an interior detail view of a handle of the carton according to the first embodiment of the disclosure.

In one embodiment, the handle features comprise a handle reinforcement flap 181 foldably connected to the second top panel 129 along a lateral fold line 183. The handle reinforcement flap 181 is at least partially defined by two cuts 185 interrupting the lateral fold line 183. In the illustrated embodiment, the cuts 185 can form respective projections 187 (FIG. 2) extending from the second top panel 129 when the handle reinforcement flap 181 is folded along the lateral fold line 183 (FIG. 2). In the embodiment of FIG. 1, the respective hook-shaped cuts 185 extend from respective ends of a central portion 189 of the lateral fold line 183 and at least partially define the projections 187. As shown in FIGS. 1 and 1A, the handle reinforcement flap 181 has a cutout 191 at a laterally extending edge 193 of the blank 103. The cutout 191 can be generally aligned with the handle openings 171, 177 along a longitudinal centerline CL of the blank 103. A grip reinforcement portion 195 can be defined between at least the cutout 191, the central portion 189 of the lateral fold line 183, and the cuts 185 for reinforcing the grip portions 173, 179 when the handle 107 is formed (FIGS. 3 and 4). In one embodiment, the handle reinforcement flap 181 can include end portions 197, 199 defined by the respective longitudinal fold lines 161, 163 and foldably connected to the respective top end flaps 155, 157 along the lateral fold line 183. The end portions 197, 199 can be folded against the respective top end flaps 155, 157 when the handle reinforcement flap 181 is folded with respect to the second top panel 129 (FIGS. 2 and 5). The handle reinforcement flap 181 could be otherwise shaped, arranged, and/or configured and could have a cutout 191 and/or end portions 197, 199 that are alternatively shaped, arranged, and/or configured without departing from the disclosure. Further, the cutout 191, the end portions 197, 199, and/or the handle reinforcement flap 181 could be omitted without departing from the disclosure.

In the illustrated embodiment, the blank 103 comprises force-directing creases or fold lines 201 extending in the top panels 123, 129 from the respective handle openings 171, 177 to the respective corners of the top panels. The force-directing creases 201 could be otherwise shaped, arranged, and/or configured without departing from the disclosure. Also, the blank 103 can include additional force-directing and/or stress-relieving creases and patterns. Further, the force-directing creases 201 could be omitted without departing from the disclosure.

Figure 6:
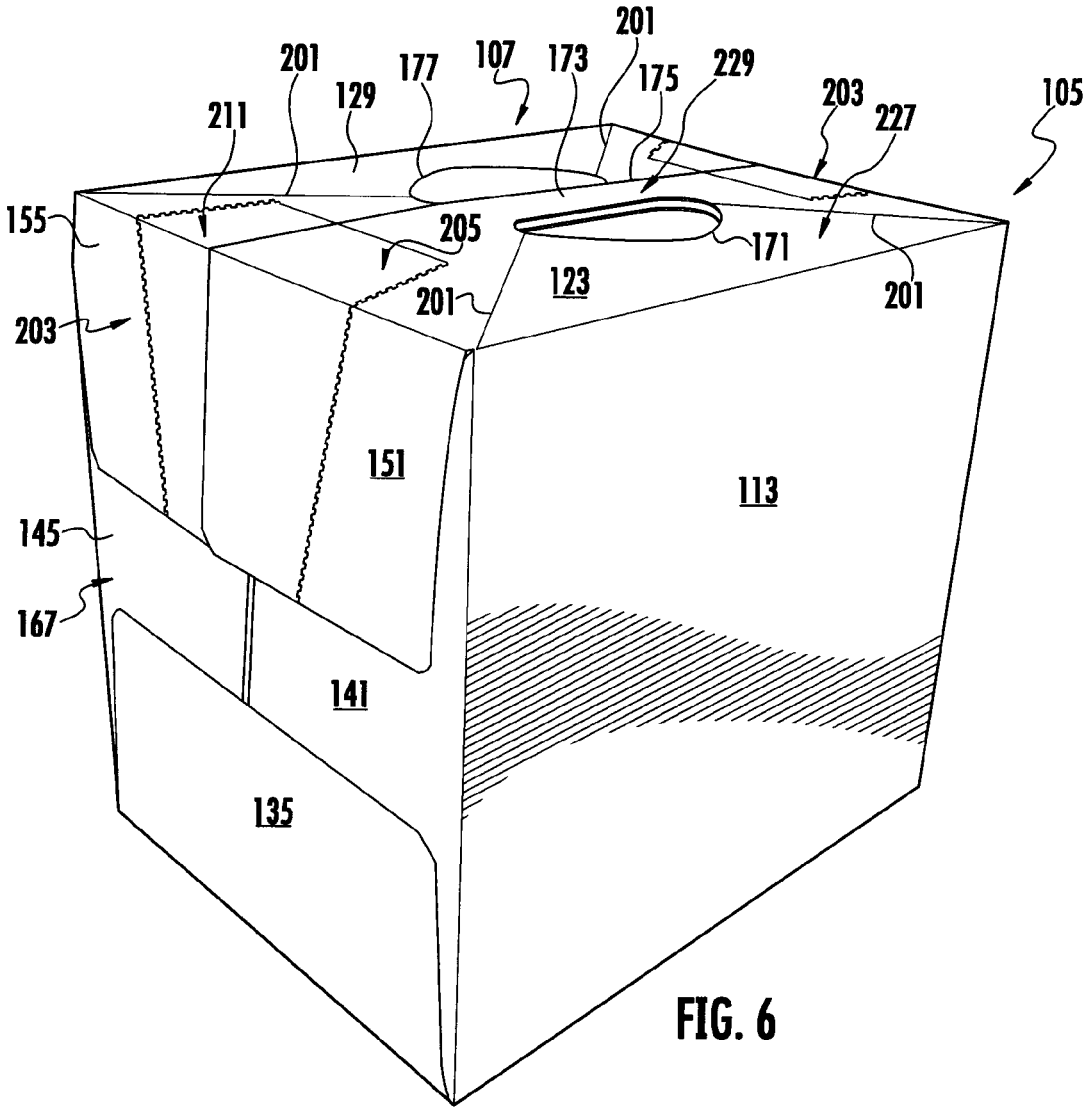
FIG. 6 is a perspective view of the carton according to the first embodiment of the disclosure.
Figure 7:
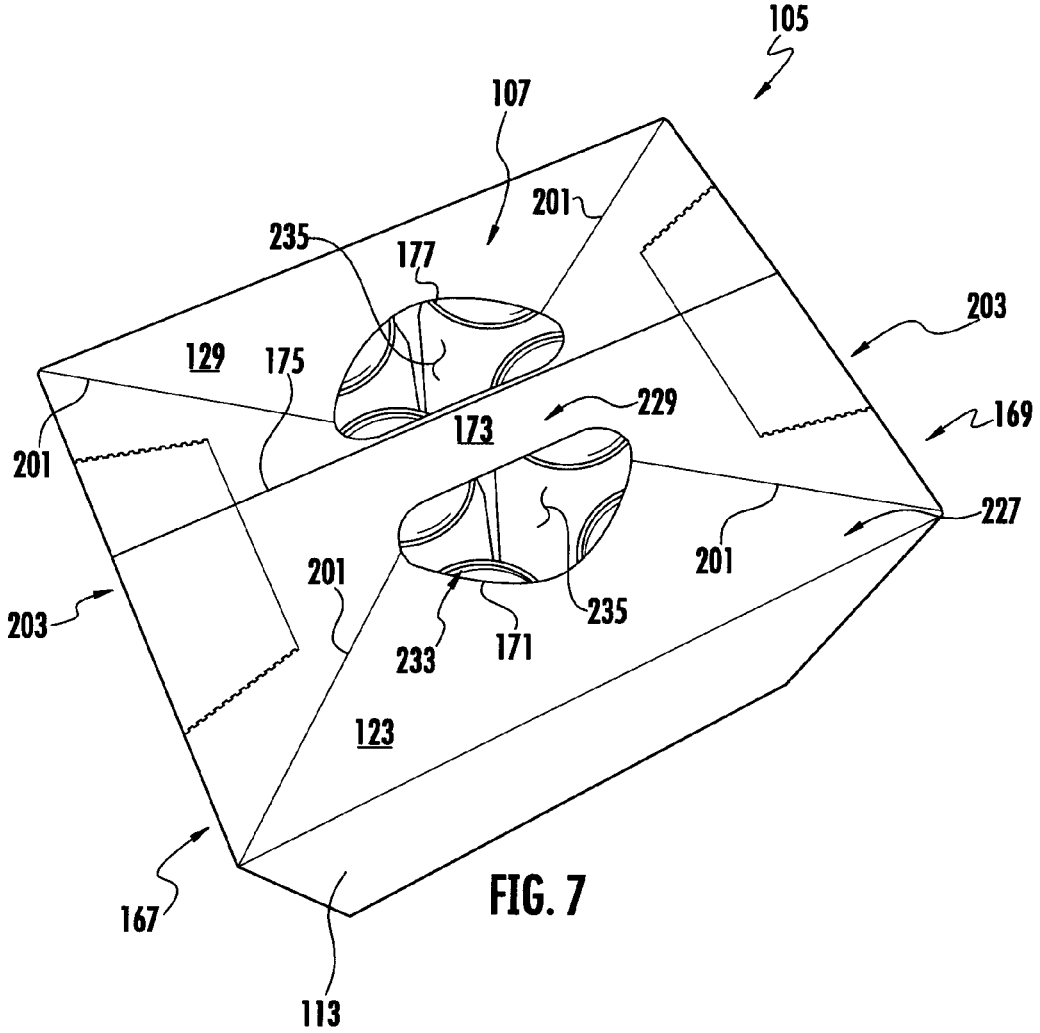
FIG. 7 is a perspective top view of the carton of FIG. 6 showing the handle of the carton.

In one embodiment, the blank 103 can include features for forming dispensers 203 in the carton 105 (FIGS. 5-7). As shown in FIG. 1, the first top panel 123 and the top end flaps 151, 155 can include first dispenser panels 205 defined by respective longitudinal fold lines 207 in the first top panel 123 and respective tear lines 209. The tear lines 209 can extend from respective ends of the fold lines 207 to the respective longitudinal fold lines 161, 163 and at least partially across the respective top end flaps 151, 153. Similarly, as shown in FIGS. 1 and 1A, the second top panel 129 and the top end flaps 155, 157 can include second dispenser panels 211 defined by respective longitudinal fold lines 213 in the second top panel 129 and respective tear lines 215. The longitudinal fold lines 213 can extend into handle reinforcement flap 181 so that the second dispenser panels 211 include portions of the handle reinforcement flap 181 and the end portions 197, 199. The tear lines 215 can extend from respective ends of the fold lines 213 to the respective longitudinal fold lines 161, 163 and at least partially across the respective top end flaps 155, 157. When the carton 105 is formed, the first dispenser panels 205 can overlap the second dispenser panels 211, and each of the dispensers 203 can be activated by pivoting the dispenser panels 205, 211 upwardly about the respective fold lines 207, 213, tearing the respective tear lines 209, 215. Dispenser cutouts 217 in the side end flaps 141, 143, 145, 147 can provide openings (not shown) in the ends 167, 169 of the carton 105 when the dispenser panels 205, 211 are pivoted upwardly. The dispensers 203 could be otherwise shaped, arranged, and/or configured without departing from the disclosure. Further, the dispensers 203 could be omitted without departing from the disclosure.

An exemplary method of erecting the carton 105 is discussed in detail below and shown in FIGS. 2-5. At various stages of the erecting process, glue or other adhesive can be applied to various portions of the blank 103. For example, one or more glue strips 219 can be applied to the interior surface of the handle reinforcement flap 181 as shown in FIG. 1A for adhering the handle reinforcement flap 181 to the interior surface of the second top panel 129 and the top end flaps 155, 157 (FIG. 2). Also, one or more glue strips (not shown) can be applied to the interior surface of the first top panel 123 and the top end flaps 151, 153 and/or to the exterior surface of the second top panel 129 and the top end flaps 155, 157 for adhering the first top panel 123 and the top end flaps 151, 153 to the exterior surface 101 of the respective second top panel 129 and top end flaps 155, 157 (FIGS. 3 and 4). The glue strips could be otherwise shaped, arranged, and/or configured without departing from the disclosure. For example, the glue strips 219 could be applied to the interior surface of the second top panel 129 instead of, or in addition to, the handle reinforcement flap 181. Further, the glue strips could be omitted without departing from the disclosure.

As shown in FIG. 2, the handle reinforcement flap 181 can be folded about lateral fold line 183 to be in face-to-face contact with an interior surface 223 of the second top panel 129 with the end portions 197, 199 being in face-to-face contact with the respective top end flaps 155, 157 and the grip reinforcement portion 195 in face-to-face contact with the grip portion 179. Accordingly, the glue strips 219 can help secure the interior surface of the handle reinforcement flap 181 to the second top panel 129 and the top end flaps 155, 157. In the illustrated embodiment, when the handle reinforcement flap 181 is folded, it separates from the second top panel 129 at the cuts 185 to form the projections 187 extending from the second top panel 129. A recess 225 can be defined by the edges of the projections 187 and the central portion 189 of the lateral fold line 183 and can be generally aligned with the handle openings 171, 177 along the longitudinal centerline CL. When the handle reinforcement flap 181 is folded, the cutout 191 can be generally aligned with the handle opening 177 in the second top panel 129 and can be disposed generally adjacent the main portion 178 of the handle opening 177.

In one embodiment, the carton 105 is further formed by folding the second top panel 129, with the folded under and attached reinforcement flap 181, and the second side panel 115 about fold line 119 to at least partially overlap the bottom panel 111 and the first side panel 113. Next, the first top panel 123 can be folded about fold line 125 so that the first top panel 123 at least partially overlaps the second top panel 129. The first top panel 123 can be secured to the second top panel 129 (e.g., by one or more glue strips) to form a top wall 227 (FIGS. 3 and 4). As shown in FIG. 3, the partially-assembled carton can be erected into an open-ended sleeve 231 with an interior 233 such as by folding the partially-erected carton along the lateral fold lines 117, 119, 125, 113 and disposing the top wall 227 generally opposite to the bottom panel 111. In one embodiment, the grip portion 173 of the first top panel 123 overlaps and is adhesively secured to the grip portion 179 of the second top panel 129, which, in turn, overlaps and is adhesively secured to the grip reinforcement portion 195 of the handle reinforcement flap 181, to form a three-ply handle grip 229 of the handle 107 (FIGS. 3 and 4). FIG. 4 shows the top wall 227 and the handle 107 from the interior of the sleeve 231. As shown in FIG. 4, the handle grip 229 of the handle 107 includes the grip reinforcement portion 195 overlapped by the grip portions 173, 179 of the respective top panels 123, 129, the cutout 191 is aligned with the handle opening 177 in the second top panel 129, and the recess 225 is aligned with the handle opening 171 in the first top panel 123. The top wall 227 and the handle 107 could be formed by other forming steps and features without departing from the disclosure.

In one embodiment, the containers C can be loaded into the interior 233 of the sleeve 231 after the open-ended sleeve 231 is formed as shown in FIG. 3. The ends 167, 169 of the sleeve 231 can be closed by at least partially overlapping and adhering the end flaps 135, 141, 145, 151, 155 at the first end 167 and at least partially overlapping and adhering the end flaps 137, 143, 147, 153, 157 at the second end 169. For example, as shown in FIG. 5, the second end 169 can be closed by downwardly folding and securing the overlapped top end flaps 153, 157 to the side end flaps 143, 147. The bottom end flap 137 can be upwardly folded and secured to the side end flaps 143, 147 before or after securing the top end flaps 153, 157. The containers C can be loaded into the sleeve 231 before closing the ends 167, 169, and/or after closing either of the ends 167, 169. The erected carton is shown in FIGS. 6 and 7. The ends 167, 169 of the carton 105 could be closed by other closing steps and features and/or alternatively loaded without departing from the disclosure.

In the illustrated embodiment, the handle 107 is formed from the handle features of the blank 103 and comprises three layers of blank material at the handle grip 229 (the first grip portion 173, the second grip portion 179, and the grip reinforcement portion 195) and extending into the ends 167, 169. The handle 107 could have other features and could include additional reinforcing layers or portions without departing from the disclosure. The handle 107 could be otherwise formed without departing from the disclosure. For example, the handle reinforcement flap 181 could be omitted and/or the top wall 227 could be replaced by a single top panel, wherein the handle openings 171, 177 can extend in the single top panel with a handle grip in the single top panel between the handle openings 171, 177.

The extended shape of the handle openings 171, 177 can help avoid unwanted tearing in the carton 105. For example, when the carton 105 is stacked or placed on a shelf so that it is difficult or impossible for a user to properly grasp the handle grip 229 of the handle 107 for carrying the carton 105, the user may grasp one of the top panels 123, 129 at the respective handle opening 171, 177 and pull the carton 105 closer to the user along a shelf or other surface until the user can properly grasp the handle 107. In this case, a substantial force (e.g., to overcome the friction between the carton 105 and the surface and/or the weight of the carton 105 and the containers C) can be applied to one of the top panels 123, 129, which can result in undesired ripping of the carton 105. However, the extended shape of the handle openings 171, 177, and their alignment with spaces 235 between the containers C (FIGS. 1A and 7), can encourage the user to reach into the interior 233 of the carton 105 through the expanded portion 180 and/or the main portion 178 of at least one of the handle openings 171, 177 into one of the spaces 235 (FIG. 7). The user can then at least partially apply the force for pulling and/or sliding the carton 105 to the containers C adjacent the respective handle opening 171, 177 and the respective side wall 113, 115. Accordingly, the containers C can help distribute the force.

Figure 8:
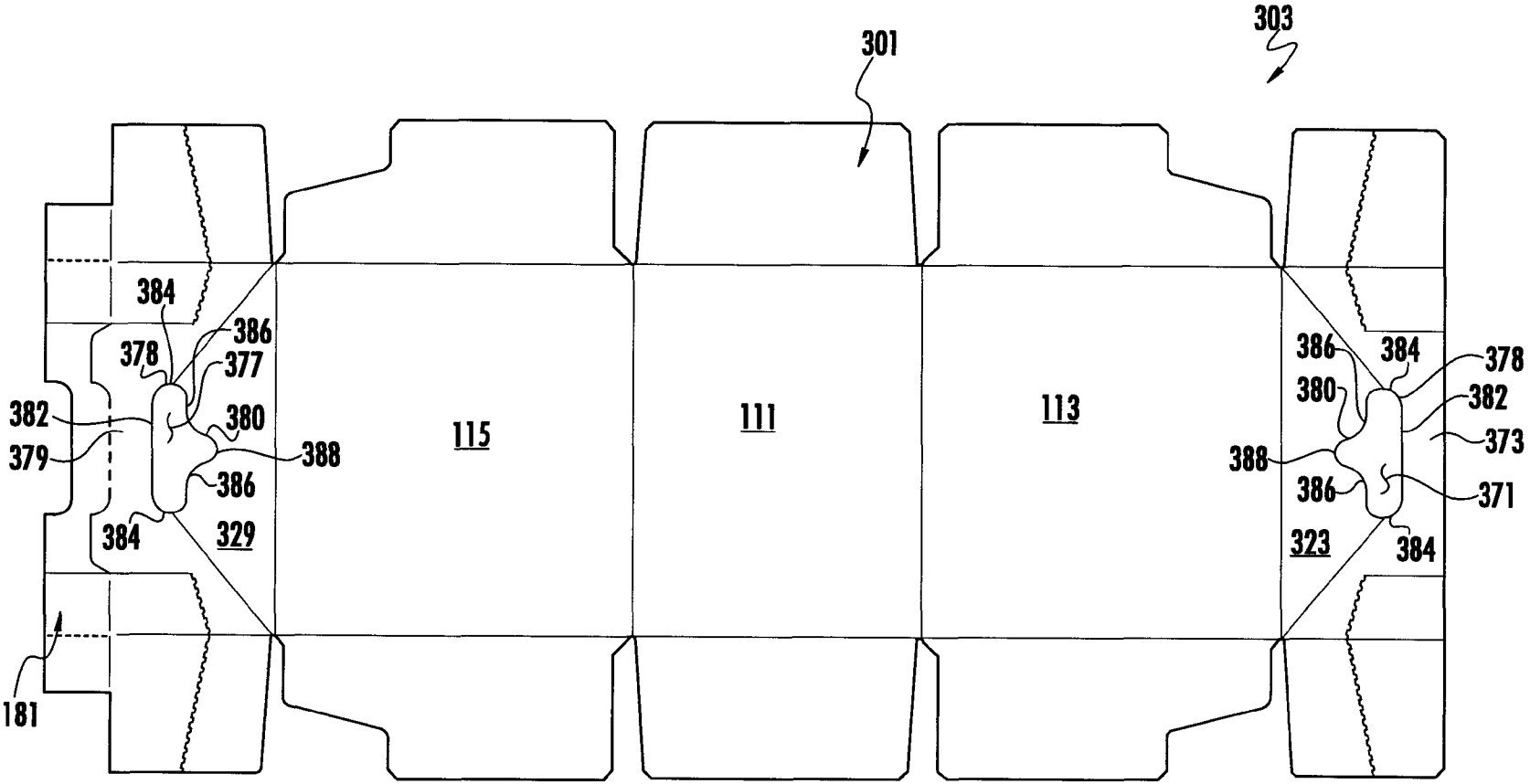
FIG. 8 is an exterior plan view of a blank for forming a carton according to a second exemplary embodiment of the disclosure.

FIG. 8 is a plan view of an exterior surface 301 of an alternative reinforcing insert blank 303 for forming a carton (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 8, the blank 303 includes handle openings 371, 377 with a different shape than the handle openings 171, 177 of the first embodiment. Each of the handle openings 371, 377 includes a main portion 378 extending adjacent the respective grip portions 373, 379 of the respective top panels 323, 329 and an expanded portion 380 extending toward the bottom panel 111 from the respective main portions 378. In the second embodiment, the expanded portions 380 can be narrower than the extended portions 180 of the first embodiment to help direct one or more fingers of a user's hand into the spaces between the containers C in the carton (e.g., spaces 235 of FIG. 7). For example, as shown in FIG. 8, each of the handle openings 371, 377 can include a grip edge 382 and two curved edges 384 that at least partially define the main portion 378 of the handle opening and two generally convex edges 386 and a concave edge 388 that at least partially define the expanded portion 380 of the handle opening. As shown in FIG. 8, the convex edges 386 can extend from the respective curved edges 384, and the concave edge 388 can extend from the respective ends of the convex edges 386. In alternative embodiments, the expanded portions 180, 380 can have any suitable shape for providing access to the spaces 235 between the containers C in the carton.

It is noted that the handle features of the various embodiments can be incorporated into a carton having any suitable carton style or panel configuration. The carton styles and panel configurations described above are included by way of example.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiment of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue. The term "glue" is intended to encompass all manner of adhesives commonly used to secure carton panels or flaps in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton;

a handle extending in at least one panel of the plurality of panels, the handle comprising a handle grip and at least one handle opening, the at least one handle opening comprising a main portion extending adjacent the handle grip of the handle and an expanded portion that is for being generally aligned with a respective space at least partially defined by at least two adjacent articles of the plurality of articles, the expanded portion allowing access to the respective space via the at least one handle opening;

the main portion of the at least one handle opening comprises a grip edge generally extending in a lateral direction and at least partially defining the handle grip, a first curved edge and a second curved edge extending from respective ends of the grip edge, and the expanded portion of the at least one handle opening comprises two generally concave edges extending from the respective first curved edge and second curved edge of the main portion of the at least one handle opening, the concave edges of the expanded portion of the at least one handle opening intersecting at a point that is spaced apart from the grip edge in a longitudinal direction and the handle grip comprises at least one grip portion that extends in the at least one panel from the main portion of the at least one handle opening to a free edge of the at least one panel.

2. The carton of claim 1, further comprising a handle reinforcement flap foldably connected to the at least one panel, the at least one panel at least partially overlapping the handle reinforcement flap.

3. The carton of claim 2, wherein the handle reinforcement flap comprises a cutout that is aligned with at least a portion of the at least one handle opening.

4. The carton of claim 2, wherein the handle grip of the handle comprises at least one grip portion extending in the at least one panel and a grip reinforcement portion extending in the handle reinforcement flap, the at least one grip portion at least partially overlapping the grip reinforcement portion.

5. A carton for containing a plurality of articles, the carton comprising:

a plurality of panels that extends at least partially around an interior of the carton;

a handle extending in at least one panel of the plurality of panels, the handle comprising a handle grip and at least one handle opening, the at least one handle opening comprising a main portion extending adjacent the handle grip of the handle and an expanded portion that is for being generally aligned with a respective space at least partially defined by at least two adjacent articles of the plurality of articles, the expanded portion allowing access to the respective space via the at least one handle opening;

the main portion of the at least one handle opening comprises a grip edge generally extending in a lateral direction and at least partially defining the handle grip, a first curved edge and a second curved edge extending from respective ends of the grip edge, and the expanded portion of the at least one handle opening comprises two generally concave edges extending from the respective first curved edge and second curved edge of the main portion of the at least one handle opening, the concave edges of the expanded portion of the at least one handle opening intersecting at a point that is spaced apart from the grip edge in a longitudinal direction;

a handle reinforcement flap foldably connected to the at least one panel, the at least one panel at least partially overlapping the handle reinforcement flap;

the handle grip of the handle comprises at least one grip portion extending in the at least one panel and a grip reinforcement portion extending in the handle reinforcement flap, the at least one grip portion at least partially overlapping the grip reinforcement portion; and the handle reinforcement flap is foldably connected to the at least one panel along a fold line, and the grip reinforcement portion extends at least from the fold line to the cutout of the handle reinforcement flap.

6. The carton of claim 1, wherein the at least one panel comprises at least a first panel and a second panel, the first panel at least partially overlaps the second panel, and at least a portion of the handle extends in each of the first panel and the second panel.

7. The carton of claim 6, wherein the at least one handle opening comprises a first handle opening extending in the first panel and a second handle opening extending in the second panel, the first handle opening being spaced apart from the second handle opening by at least a portion of the handle grip of the handle.

8. The carton of claim 7, wherein the handle grip comprises a first grip portion extending in the first panel and a second grip portion extending in the second panel, the first grip portion at least partially overlapping the second grip portion.

9. A carton for containing a plurality of articles, the carton comprising:

a plurality of panels that extends at least partially around an interior of the carton;

a handle extending in at least one panel of the plurality of panels, the handle comprising a handle grip and at least one handle opening, the at least one handle opening comprising a main portion extending adjacent the handle grip of the handle and an expanded portion that is for being generally aligned with a respective space at least partially defined by at least two adjacent articles of the plurality of articles, the expanded portion allowing access to the respective space via the at least one handle opening;

the main portion of the at least one handle opening comprises a grip edge generally extending in a lateral direction and at least partially defining the handle grip, a first curved edge and a second curved edge extending from respective ends of the grip edge, and the expanded portion of the at least one handle opening comprises two generally concave edges extending from the respective first curved edge and second curved edge of the main portion of the at least one handle opening, the concave edges of the expanded portion of the at least one handle opening intersecting at a point that is spaced apart from the grip edge in a longitudinal direction;

the at least one panel comprises at least a first panel and a second panel, the first panel at least partially overlaps the second panel, and at least a portion of the handle extends in each of the first panel and the second panel;

the at least one handle opening comprises a first handle opening extending in the first panel and a second handle opening panel the first handle in being spaced apart from the second handle opening by at least a portion of the handle grip of the handle;

the handle grip comprises a first grip portion extending in the first panel and a second grip portion extending in the second panel, the first grip portion at least partially overlapping the second grip portion; and the second panel comprises a first projection, a second projection, and a recess extending from the first projection to the second projection adjacent at least a portion of the second grip portion, at least a portion of the first top panel overlapping the first projection and the second projection.

10. The carton of claim 9, further comprising a handle reinforcement flap foldably connected to the second panel, the second panel at least partially overlapping the handle reinforcement flap, and the handle grip of the handle further comprises a grip reinforcement portion extending in the handle reinforcement flap, the second grip portion at least partially overlapping the grip reinforcement portion.

11. The carton of claim 10, wherein the recess of the second panel is generally aligned with at least the main portion of the first handle opening in the first panel, and the handle reinforcement flap comprises a cutout that is aligned with at least a portion of the second handle opening in the second panel.

12. The carton of claim 6, further comprising a handle reinforcement flap foldably connected to the second panel, wherein the handle grip comprises a first grip portion extending in the first panel, a second grip portion extending in the second panel, and a grip reinforcement portion extending in the handle reinforcement flap, the second grip portion at least partially overlaps the grip reinforcement portion, and the first grip portion at least partially overlaps the second grip portion.

13. A carton for containing a plurality of articles, the carton comprising:

a plurality of panels that extends at least partially around an interior of the carton;

a handle extending in at least one panel of the plurality of panels, the handle comprising a handle grip and at least one handle opening, the at least one handle opening comprising a main portion extending adjacent the handle grip of the handle and an expanded portion that is for being generally aligned with a respective space at least partially defined by at least two adjacent articles of the plurality of articles, the expanded portion allowing access to the respective space via the at least one handle opening, wherein the main portion of the at least one handle opening comprises a grip edge generally extending in a lateral direction and at least partially defining the handle grip, and a first curved edge and a second curved edge extending from respective ends of the grip edge, and the expanded portion of the at least one handle opening comprises two generally convex edges extending from the respective first curved edge and second curved edge of the main portion of the at least one handle opening and a concave edge extending between the convex edges, the concave edge for being generally aligned with the respective space, and wherein the handle grip comprises at least one grip portion that extends in the at least one panel from the main portion of the at least one handle opening to a free edge of the at least one panel.

14. A blank for forming a carton for containing a plurality of articles, the blank comprising:

a plurality of panels;

handle features extending in at least one panel of the plurality of panels for forming a handle when the carton is formed from the blank, the handle features comprising at least one grip portion for forming a handle grip in the carton formed from the blank and at least one handle opening, the at least one handle opening comprising a main portion extending adjacent the at least one grip portion and an expanded portion that is for being generally aligned with a respective space at least partially defined by at least two adjacent articles of the plurality of articles when the carton is formed from the blank, the expanded portion allowing access to the respective space via the at least one handle opening in the carton formed from the blank;

the main portion of the at least one handle opening comprises a grip edge generally extending in a lateral direction and at least partially defining the handle grip, a first curved edge, a second curved edge extending from respective ends of the grip edge, and the expanded portion of the at least one handle opening comprises two generally concave edges extending from the respective first curved edge and second curved edge of the main portion of the at least one handle opening, the concave edges of the expanded portion of the at least one handle opening intersecting at a point that is spaced apart from the grip edge in a longitudinal direction, and wherein the at least one grip portion extends in the at least one panel from the main portion of the at least one handle opening to a free edge of the at least one panel.

15. The blank of claim 14, further comprising a handle reinforcement flap foldably connected to the at least one panel, the at least one panel at least partially overlapping the handle reinforcement flap.

16. The blank of claim 15, wherein each of the at least one handle opening and the handle reinforcement flap is generally aligned with a centerline.

17. The blank of claim 15, wherein the handle features comprise a grip reinforcement portion extending in the handle reinforcement flap, the at least one grip portion being for at least partially overlapping the grip reinforcement portion when the carton is formed from the blank.

18. The blank of claim 17, wherein the handle reinforcement flap is foldably connected to the at least one panel along a fold line, and the grip reinforcement portion extends at least from the fold line to the cutout of the handle reinforcement flap.

19. The blank of claim 14, wherein the at least one panel comprises at least a first panel and a second panel, the first panel is for at least partially overlapping the second panel when the carton is formed from the blank, and at least a portion of the handle extends in each of the first panel and the second panel.

20. The blank of claim 19, wherein the at least one handle opening comprises a first handle opening extending in the first panel and a second handle opening extending in the second panel.

21. The blank of claim 20, wherein the at least one grip portion comprises a first grip portion extending in the first panel and a second grip portion extending in the second panel, the first grip portion being for at least partially overlapping the second grip portion when the carton is formed from the blank.

22. The blank of claim 21, wherein the second panel comprises a first projection, a second projection, and a recess extending from the first projection to the second projection adjacent at least a portion of the second grip portion, at least a portion of the first top panel being for overlapping the first projection and the second projection when the carton is formed from the blank.

23. The blank of claim 22, further comprising a handle reinforcement flap foldably connected to the second panel, and the handle features further comprises a grip reinforcement portion extending in the handle reinforcement flap, the second panel being for at least partially overlapping the handle reinforcement flap and the second grip portion being for at least partially overlapping the grip reinforcement portion when the carton is formed from the blank.

24. The blank of claim 23, wherein the handle reinforcement flap comprises a cutout, and each of the first handle opening, the second handle opening, the recess of the second panel, and the cutout of the handle reinforcement flap is generally aligned with a centerline.

25. The blank of claim 19, further comprising a handle reinforcement flap foldably connected to the second panel, wherein the at least one grip portion comprises a first grip portion extending in the first panel and a second grip portion extending in the second panel, and the handle features further comprise a grip reinforcement portion extending in the handle reinforcement flap, the second grip portion being for at least partially overlapping the grip reinforcement portion and the first grip portion being for at least partially overlapping the second grip portion when the carton is formed from the blank.

26. A blank for forming a carton for containing a plurality of articles, the blank comprising:

a plurality of panels;

handle features extending in at least one panel of the plurality of panels for forming a handle when the carton is formed from the blank, the handle features comprising at least one grip portion for forming a handle grip in the carton formed from the blank and at least one handle opening, the at least one handle opening comprising a main portion extending adjacent the at least one grip portion and an expanded portion that is for being generally aligned with a respective space at least partially defined by at least two adjacent articles of the plurality of articles when the carton is formed from the blank, the expanded portion allowing access to the respective space via the at least one handle opening in the carton formed from the blank, wherein the main portion of the at least one handle opening comprises a grip edge generally extending in a lateral direction and at least partially defining the handle grip, and a first curved edge and a second curved edge extending from respective ends of the grip edge, and the expanded portion of the at least one handle opening comprises two generally convex edges extending from the respective first curved edge and second curved edge of the main portion of the at least one handle opening and a concave edge extending between the convex edges, the concave edge for being generally aligned with the respective space when the carton is formed from the blank, and the at least one grip portion extends in the at least one panel from the main portion of the at least one handle opening to a free edge of the at least one panel.

27. A method of forming a carton for containing a plurality of articles, the method comprising:

obtaining a blank comprising a plurality of panels and handle features extending in at least one panel of the plurality of panels, the handle features comprising at least one grip portion and at least one handle opening, the at least one handle opening comprising a main portion extending adjacent the at least one grip portion and an expanded portion;

the main portion of the at least one handle opening comprises a grip edge generally extending in a lateral direction and at least partially defining the handle grip, a first curved edge and a second curved edge extending from respective ends of the grip edge, and the expanded portion of the at least one handle opening comprises two generally concave edges extending from the respective first curved edge and second curved edge of the main portion of the at least one handle opening, the concave edges of the expanded portion of the at least one handle opening intersecting at a point that is spaced apart from the grip edge in a longitudinal direction, and the at least one grip portion extends in the at least one panel from the main portion of the at least one handle opening to a free edge of the at least one panel;

forming an interior of the carton at least partially defined by the plurality of panels, the forming the interior of the carton comprising forming an open-ended sleeve;

forming a handle from the handle features at least by forming a handle grip adjacent the at least one handle opening from the at least one grip portion and aligning the expanded portion with a respective space at least partially defined by at least two adjacent articles of the plurality of articles, the expanded portion allowing access to the respective space via the at least one handle opening.

28. The method of claim 27, wherein the blank further comprises a handle reinforcement flap comprising a grip reinforcement portion and a cutout adjacent the grip reinforcement portion, the forming the open-ended sleeve comprises positioning the handle reinforcement flap to be overlapped by the at least one panel, and the forming the handle comprises positioning the at least one grip portion to overlap the grip reinforcement portion and at least partially aligning the at least one handle opening with the cutout.

29. The method of claim 28, wherein the at least one panel comprises at least a first panel and a second panel, the at least one grip portion comprises at least a first grip portion and a second grip portion, the at least one handle opening comprises at least a first handle opening and a second handle opening, the forming the open-ended sleeve comprises positioning the first panel to at least partially overlap the second panel, and the forming the handle comprises positioning the first grip portion to at least partially overlap the second grip portion.

30. The method of claim 29, wherein the handle reinforcement flap is foldably connected to the second panel, the positioning the handle reinforcement flap comprises folding the handle reinforcement flap relative to the second panel so that a first projection and a second projection extending from the second panel are formed, a recess extending between the first projection and the second projection, and the forming the handle comprises at least partially aligning the recess with the first handle opening in the first panel.

31. The method of claim 27, wherein the at least one panel comprises at least a first panel and a second panel, the at least one grip portion comprises at least a first grip portion and a second grip portion, the at least one handle opening comprises at least a first handle opening and a second handle opening, the forming the open-ended sleeve comprises positioning the first panel to at least partially overlap the second panel, and the forming the handle comprises positioning the first grip portion to at least partially overlap the second grip portion so that the first handle opening is spaced apart from the second handle opening by the at least partially overlapped first grip portion and second grip portion.

32. A method of using a carton containing a plurality of articles, the method comprising:

obtaining a carton comprising a plurality of panels that extends at least partially around an interior of the carton and a handle extending in at least one panel of the plurality of panels, the handle comprising a handle grip and at least one handle opening, the at least one handle opening comprising a main portion extending adjacent the handle grip of the handle and an expanded portion that is generally aligned with a respective space at least partially defined by at least two adjacent articles of the plurality of articles;

the main portion of the at least one handle opening comprises a grip edge generally extending in a lateral direction and at least partially defining the handle grip, a first curved edge and a second curved edge extending from respective ends of the grip edge, and the expanded portion of the at least one handle opening comprises two generally concave edges extending from the respective first curved edge and second curved edge of the main portion of the at least one handle opening, the concave edges of the expanded portion of the at least one handle opening intersecting at a point that is spaced apart from the grip edge in a longitudinal direction, and the handle grip comprises at least one grip portion that extends in the at least one panel from the main portion of the at least one handle opening to a free edge of the at least one panel;

gripping the carton at the handle by inserting at least a portion of a hand into the expanded portion of the at least one handle opening and into the respective space; and moving the carton by applying at least a portion of a moving force against at least one of the articles of the plurality of articles.

33. A method of using a carton containing a plurality of articles, the method comprising:

obtaining a carton comprising a plurality of panels that extends at least partially around an interior of the carton and a handle extending in at least one panel of the plurality of panels, the handle comprising a handle grip and at least one handle opening, the at least one handle opening comprising a main portion extending adjacent the handle grip of the handle and an expanded portion that is generally aligned with a respective space at least partially defined by at least two adjacent articles of the plurality of articles;

gripping the carton at the handle by inserting at least a portion of a hand into the expanded portion of the at least one handle opening and into the respective space; and moving the carton by applying at least a portion of a moving force against at least one of the articles of the plurality of articles, wherein the main portion of the at least one handle opening comprises a grip edge generally extending in a lateral direction and at least partially defining the handle grip, and a first curved edge and a second curved edge extending from respective ends of the grip edge, and the expanded portion of the at least one handle opening comprises two generally convex edges extending from the respective first curved edge and second curved edge of the main portion of the at least one handle opening and a concave edge extending between the convex edges, the concave edge being generally aligned with the respective space, and the handle grip comprises at least one grip portion that extends in the at least one panel from the main portion of the at least one handle opening to a free edge of the at least one panel.

34. The method of claim 32, wherein the respective space is defined by four adjacent articles of the plurality of articles.

* * * * *